US005997383A

United States Patent [19]

Tseng

[11] Patent Number: 5,997,383

[45] Date of Patent: Dec. 7, 1999

[54] ISOSTATIC PRESSURE PLASTIC GRINDING METHOD

[76] Inventor: Shao-Chien Tseng, No.130, Sec 2. Yang-Shin Rd., Yang-Mei Taoyuan 326, Taiwan

[21] Appl. No.: 09/061,011

[22] Filed: Apr. 16, 1998

[51] Int. Cl.[6] ..... B24B 31/06

[52] U.S. Cl. ..... 451/36; 451/113

[58] Field of Search ..... 451/36, 37, 104, 451/113

[56] References Cited

U.S. PATENT DOCUMENTS

| | | | |
|---|---|---|---|
| 2,994,165 | 8/1961 | Brevik | 451/113 X |
| 3,564,775 | 2/1971 | Bodine | 451/113 |
| 5,384,989 | 1/1995 | Shibano | 451/104 X |
| 5,593,339 | 1/1997 | Yam et al. | 451/104 X |

*Primary Examiner*—David A. Scherbel
*Assistant Examiner*—Anthony Ojini
*Attorney, Agent, or Firm*—Pro-Techtor International Services

[57] ABSTRACT

A plastic grinding method under isostatic pressure, wherein, by using a container capable of increasing liquid pressure and generating vibration with supersonic waves, work-pieces to be ground and a grinding compound and grinding granules are placed in the container, the liquid pressure of the grinding compound in the container is raised to a predetermined value according to the Pascal's law, so that the high pressure grinding compound in the container can form a grinding vibration with supersonic waves, and an Blaha effect and a cavitation effect can be created thereby to lower the stress on the surfaces of the work-pieces, by these two principles, the whole work-pieces can be ground and polished exactly along the whole contours thereof with better accuracy and efficiency, and plastic shaping ability of the work-pieces can be enhanced.

5 Claims, 2 Drawing Sheets

ISOSTATIC PRESSURE PLASTIC GRINDING METHOD

BACKGROUND OF THE INVENTION

1. Field of the Invention

The present invention is related to a plastic grinding method under isostatic pressure, and especially to a method which can be used for grinding workpieces made of harder metal or alloy with three dimentional shapes, wherein, it includes using of a container capable of bearing high pressure and of generating vibration with supersonic waves, work-pieces to be ground and grinding granules and a grinding compound required are placed in the container, then increase the liquid pressure of the grinding compound to a predetermined value, so that a thrust function of isostatic pressure can be applied to the surfaces of the workpieces (the Pascal's law) from the grinding granules activated by the grinding compound, together with the additional function of vibration with supersonic waves generated in the container, stress on the surfaces of the workpieces made of metal or alloy bearing the isostatic pressure function are much reduced (Blaha effect), then the grinding compound and the grinding granules have a better result of grinding on the workpieces under the isostatic pressure circumstance and the Cavitation effect formed by the vibration with supersonic waves.

2. Description of the Prior Art

A conventional processing technique of polishing by fine cutting on a work-piece by using the vibrational grinding technique has been known for long, wherein, a liquid grinding compound and grinding granules are placed in a grinding chamber of a grinding machine, by a vibrating motor having a biasing weight, it can generate a vibration force in a predetermined angle, and thereby can make the grinding compound and grinding granules create disturbing collision styled grinding cutting action on the work-piece to be ground, so that the surfaces of the work-piece are smoothened, and the object of polishing can be achieved.

However, in the above stated conventional vibrational grinding technique, a technique of allocation for getting the angular scope of vibration of the vibration motor is very important, a good design can get a three dimensional turbulent vortex styled collision grinding and grinding effect among the work-piece, the grinding compound and the grinding granules in the grinding chamber, and hence quality of the work-piece can be largely improved.

There is still a technical impedance which has been being difficult to be overcome even when using the most well-done three dimensional vibrational grinding technique, this is because even the most well-done three dimensional vibrational grinding technique can hardly perform grinding and polishing on a work-piece having an small hole or fine slit; and it is difficult to keep the original sharpness of angles and edges in getting the smoothness after grinding of the whole three dimensional walls on a coarse blank made of metal or alloy with higher hardness or the work-piece having angles and edges; and even more, it is very difficult to use the vibrational grinding technique for grinding and polishing the work-pieces having more complicated three dimensional contours (those having undulated surfaces) in mass production, this is also a well known technical impedance in the art.

The largest problems making the conventional three dimensional vibrational grinding technique difficult in grinding the work-pieces having small holes or fine slits or the work-pieces having more complicated three dimensional contours does not exist in selection of the material of the grinding compounds and the grinding granules, in fact, it exists in the phenomenon wherein disturbant collision with unequal pressure is generated among the work-pieces to be ground three dimensionally and the grinding granules and the grinding compounds, this phenomenon is used to create tangential collision between the work-pieces to be ground and the grinding granules via the grinding compounds, so that the effect of grinding and cutting can be achieved; However, it is known that, in a circumstance with unequal pressure, tangential disturbant grinding and cutting can hardly get the grinding granules into the small holes and fine slits to form tangential grinding action, i.e., the axle holes and the fine slits are lack of enough space for the collision styled grinding cutting with tangential grinding action, and this is the primary cause why the conventional three dimensional vibrational grinding technique is difficult in grinding and polishing the work-pieces having axle holes or fine slits or the work-pieces having more complicated three dimensional contours. Further, vibrational grinding with tangential grinding action often hurt the areas having sharp angles or edges by collision or striking, this is also a large problem; And more, work-pieces made of metal or alloy with overly high hardness ground in vibration with tangential grinding action under a non equalized pressure circumstance may have the trouble of having a seriously insufficient frictional coefficient, this is not economic.

SUMMARY OF THE INVENTION

The object of the present invention is to solve the trouble of difficulty in grinding and polishing the work-pieces having small holes or fine slits or the work-pieces having more complicated three dimensional contours in the conventional vibrational grinding technique, and to provide a plastic grinding method combined by the two functions, equalized pressure vibration as well as vibration with supersonic waves, to thereby suit dealing with the work-pieces having simple contours or having complicated three dimensional contours with angles and edges, the small holes and fine slits etc., and to lower the stress on the surfaces of the metal or alloy under cooperation of the Blaha effect of the supersonic waves, to proceed the grinding and polishing on each whole work-piece under isostatic pressure, and thereby to increase the quality and efficiency of grinding accuracy of the work-pieces.

To obtain the above stated object, the present invention is provided with the following characteristics:

1. By using the Pascal's law to increase the liquid pressure of the grinding compound in the container, so that a coagulation action force of isostatic pressure is formed among a plurality of work-pieces, grinding granules and a grinding compound and has all the surfaces of the work-pieces (including the small holed or fine slits or the walls of the work-pieces having complicated three dimensional contours) borne an equalized uniform pressure exerted by the grinding granules and the grinding compound, so that the scope of grinding of the work-pieces is improved to be overall.

2. By using the Blaha effect created by the vibration with supersonic waves to lower the stress on the surfaces of the metal or alloy walls of the work-pieces, this increases plasticity and reduces hardness of the work-pieces, so that plastic grinding of the work-pieces can be better.

3. By combination of the functions of the overall equalized uniform pressure and the high frequency vibration with supersonic waves (i.e., the strength of the super sonic waves)

exerted on all the surfaces of the workpieces, the stress on all the surfaces of the work-pieces are effectively lowered, this makes effective reducing of the hardness of the work-pieces, and makes effective overall friction of the grinding granules and the grinding compound, that is, an overall cavitation effect is created on the walls of the work-pieces, so that the whole work-pieces can be ground and polished exactly along the whole contours thereof with better accuracy and efficiency.

The present invention will be apparent in its technique and contents thereof after reading the detailed description of the preferred embodiments thereof in reference to the accompanying drawings.

DETAILED DESCRIPTION OF THE PREFERRED EMBODIMENT

Figure 1:
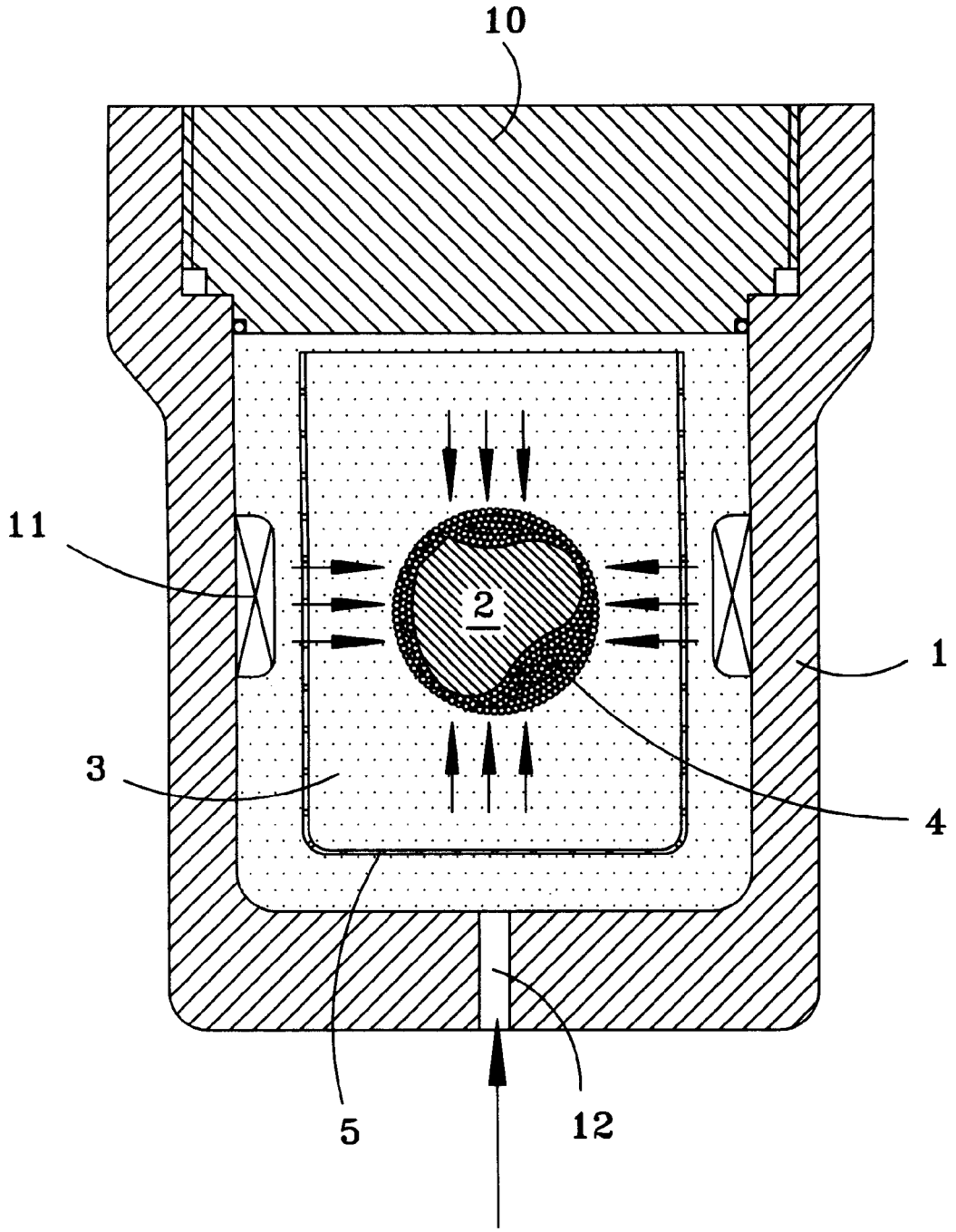
FIG. 1 is a schematic view of a container used in the present invention.

Referring to FIG. 1, the plastic grinding method under isostatic pressure disclosed in the present invention is performed in a container 1 with high pressure, the container 1 is provided in the wall thereof with a supersonic wave vibration element 11, and is provided on the top thereof with a lid 10, and on the bottom thereof with a fluid pressure increasing port 12. Wherein, the surrounding walls of the container 1 all have multiple layers and can bear high internal pressure (this can be done by a conventional technique). The fluid pressure increasing port 12 is used as a passage of the high pressure liquid grinding compound 3 injected from outside; injection of the grinding compound 3 by the high pressure (this can also be done by a conventional technique) is done by providing a check valve with extremely high pressure resistance in the fluid pressure increasing port 12 which is communicated with a conveying pipe for the grinding compound 3 conveyed by high pressure outside of the container 1, therefore, a unidirection feeding of the high pressure grinding compound 3 into the container 1 can be performed. And the container 1 can have the twin capabilities of having the fluid pressure therein increased and having a vibration with supersonic waves created therein.

Then place grinding granules 4 into the container 1, and a fencing net 5 for holding a work-piece 2 is placed together with the latter in the container 1, (the fencing net 5 shown in FIG. 1 holding therein only one work-piece 2 is shown in an enlarged scale, practically, it can simultaneously hold a plurality of work-pieces 2 to be ground), the high pressure grinding compound 3 is injected through the fluid pressure increasing port 12 by an external force, so that the liquid pressure in the container 1 can be increased to a predetermined value according to the quality of the material of a work-piece 2, the amount to be ground and the accuracy of grinding and cutting required, so that the container 1 can have therein equalized uniform pressure generated according to the Pascal's law (such as shown by the arrow in FIG. 1), to ensure the friction under isostatic pressure between the grinding compound 3 and the grinding granules 4 exerted on all the surfaces of the work-piece 2.

Figure 2:
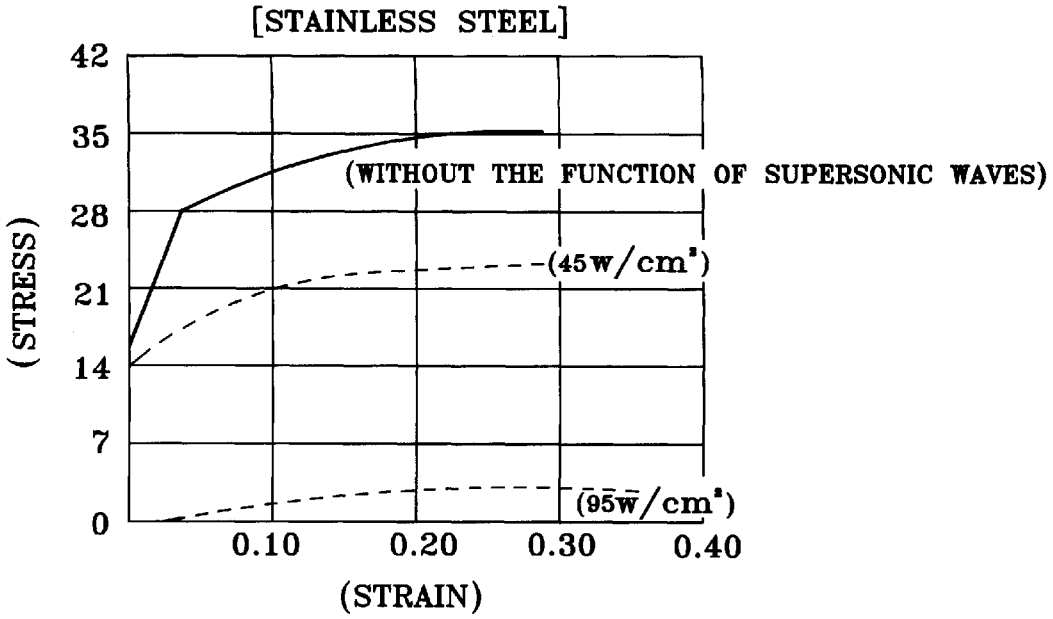
FIG. 2 is a table showing the stress on the surfaces of a stainless steel work-piece under a vibration operation with supersonic waves in the present invention.
Figure 3:
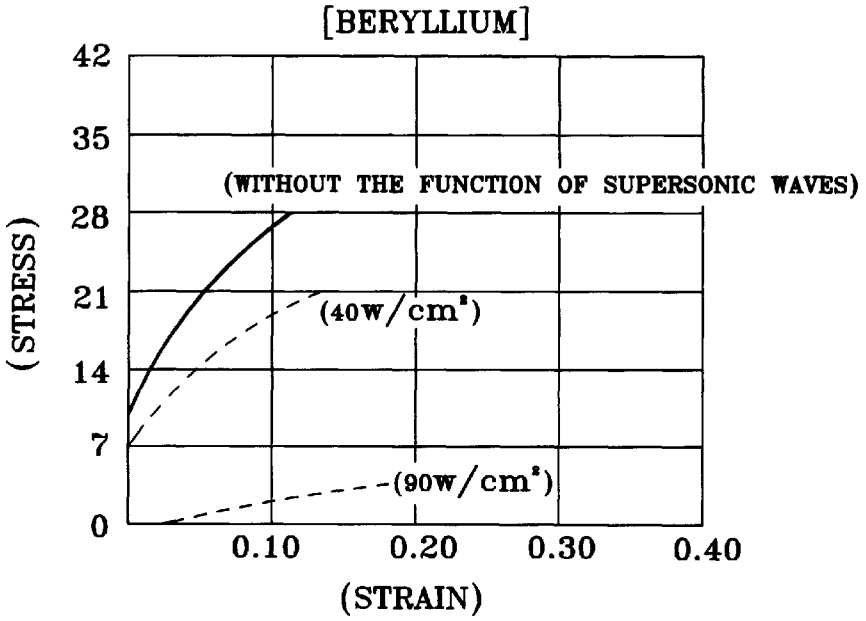
FIG. 3 is a table showing the stress on the surfaces of a beryllium work-piece under a vibration operation with supersonic waves in the present invention.

After increasing of pressure, the vibration element 11 is activated to create oscillation of high frequency, the strength of super sonic waves (or the power) of the vibration can be controlled within about 30–95 w/cm$^2$ in order to lower the stress, attraction as well as tensile force on the surfaces of the walls of the metal or alloy work-piece 2, this can create the so called Blaha effect, so that plastic shaping of the work-piece 2 can be better; taking the stainless steel and the beryllium as examples, the two kind of metals obtain their graphics of relation of changing (as shown in FIGS. 2 and 3) between stress and strain under the vibration circumstance without supersonic wave and with supersonic waves of higher and lower supersonic wave strength. It can be seen from the drawings that, when the supersonic wave strength and the amount of strain are increased, the stress of the stainless steel and the beryllium and even other metals or alloys are largely reduced, and thereby the plastic shaping ability of the work-piece 2 can be enhanced, and hardness of the metals or alloys is lowered.

Under the circumstance of combining the functions of the wholly operating action under isostatic pressure of the work-piece 2 and the high frequency vibration with supersonic wave strength, the work-piece 2 with gradually lowered surface stress can go on to be overall ground by the grinding compound 3 and the grinding granules 4, and all the surfaces of the work-piece 2 can create cavitation effect, so that the whole work-piece 2 can be ground and polished exactly along the whole contour thereof with better accuracy and efficiency.

When the internal pressure of the above stated container 1 is increased to the given pressure value required, selection of the grinding compound 3 can be in the way as below:

1. When the internal pressure of the container 1 is below 6,000 kgf/cm$^2$, water can be used as the grinding medium 3.

2. When the internal pressure of the container 1 is above 6,000 kgf/cm$^2$, ethylene glycol or the mixed solution of glycerol and methanol can be used as the grinding medium 3 (if water is used as a medium of pressure above 6,500 kgf/cm$^2$, it will be consolidated).

3. When the internal pressure of the container 1 is high up to 15,000 kgf/cm$^2$, gasoline can be used as the grinding medium 3 (this is because that gasoline is not solidified at this pressure).

The above stated grinding granules 4 has high hardness and are selected within the scope of #800–3,000 (mesh) and are added into the grinding compound 3 according to the hardness of the work-piece 2 to be ground, for example, $Al_2O_3$, SiC, $SiO_2$,$B_4C$ . . . etc. can be selected as the grinding granules 4.

In conclusion, the present invention uses a grinding compound 3 and grinding granules 4 to exert operating action under isostatic pressure on all the surfaces of the work-piece 2 in the container 1, and by the twin effects, the Blaha effect and the cavitation effect, created by the vibration with supersonic waves, surface stress in the metal or alloy work-piece 2 can be lowered, plastic shaping ability of the work-piece 2 can be enhanced, and therefore, various metal or alloy work-pieces 2 having higher hardness can be ground, and the object to do overall plastic grinding on the work-pieces 2 having angles, edges, small holes or fine slits or having more complicated three dimensional contours can be achieved, so that the work-pieces can be ground and polished exactly along the whole contours thereof with better accuracy and efficiency, this obviously is much improved.

It will be apparent to those skilled in this art that various modifications or changes can be made to the present method without departing from the spirit and scope of this invention. Accordingly, all such modifications and changes also fall within the scope of the appended claims and are intended to form part of this invention.

I claim:

1. A plastic grinding method using isostatic pressure comprising the steps of:

a) applying pressure to a container so that an isostatic condition is created in an interior of said container, b) injecting a liquid grinding compound into said container, c) placing grinding granules into said liquid grinding compound in said container, d) placing a means to hold at least one work-piece in said container, f) applying ultrasonic energy to create a plastic grinding action such that;

said work-piece is subjected to equalized uniform pressure generated according to Pascal's law, thereby said grinding compound and grinding granules grind said work-piece with said equalized uniform pressure and a Blaha effect reduces surface stress on said work-piece, and surfaces of said work-piece create a cavitation effect.

2. The plastic grinding method using isostatic pressure as claimed in claim 1, wherein:

water is used as said grinding compound.

3. The plastic grinding method using isostatic pressure as claimed in claim 1, wherein:

ethylene glycol or a solution of glycerol and methanol is used as said grinding compound.

4. The plastic grinding method using isostatic pressure as claimed in claim 1, wherein:

gasoline is used as said grinding compound.

5. The plastic grinding method using isostatic pressure as claimed in claim 1, wherein:

said ultrasonic energy in said container is provided by a vibration element in a wall of said container.

* * * * *